US005146771A

United States Patent [19]

Loughlin

[11] Patent Number: 5,146,771

[45] Date of Patent: Sep. 15, 1992

[54] SECURITY SHIELD FOR PADLOCKS

[76] Inventor: Robert W. Loughlin, P.O. Box 129, Stanton, N.J. 08885

[21] Appl. No.: 709,491

[22] Filed: Jun. 3, 1991

[51] Int. Cl.[5] ..... E05B 67/38

[52] U.S. Cl. ..... 70/56; 70/417

[58] Field of Search ..... 70/54–56, 70/51, 52, 417

[56] References Cited

U.S. PATENT DOCUMENTS

| | | | |
|---|---|---|---|
| 1,291,993 | 1/1919 | Matthews | 70/55 |
| 3,751,948 | 8/1973 | Klein | 70/55 |
| 3,783,657 | 1/1974 | Foote | 70/54 |
| 3,828,591 | 8/1974 | Beaver | 70/56 |
| 3,835,675 | 9/1974 | Lippisch | 70/52 |
| 4,760,720 | 8/1988 | Grille | 70/56 |
| 4,781,043 | 11/1988 | Loeffler | 70/54 |
| 4,905,486 | 3/1990 | Appelbaum | 70/54 |

FOREIGN PATENT DOCUMENTS 338405 8/1920 Fed. Rep. of Germany ..... 70/52

*Primary Examiner*—Renee S. Luebke
*Assistant Examiner*—D. Boucher

[57] ABSTRACT

A security shield for padlocks having U-shaped shackles and used with traditional hasp, staple, and various other types of attachment devices. The shield is a tube like device into which the padlock will fit, with a tab to limit longitudinal travel, and provided with clearance openings permitting the free swing of the unlocked shackle, and engagement with the attachment devices to be made secure. The combination of these elements provides protection for the shackle, and attachment device elements from the commonly used methods of forced attack.

1 Claim, 4 Drawing Sheets

SECURITY SHIELD FOR PADLOCKS

BACKGROUND

1. Field of Invention

This invention generally pertains to the protection of the weakest elements found in conventional padlock applications, and in particular to U-shaped shackle padlocks used in conjunction with the hasps or staples of typical attachment devices.

2. Description of Prior Art

The most commonly used padlocks and attachment devices such as hasps and staples are typical loose fitting and of "U" shape. This assures ease of use, flexibility, and minimal cost. Unfortunately these configurations provide ease of forced attack using bolt cutters, prying tools and similar methods. Many attempts have been made to protect these vulnerable elements such as can be seen in U.S. Pat. Nos. 676,001 (Jarvis), 1,220,941 (Bowers), 1,662,612 (Junkunc), and 3,572,064 (Berry et al). Other arrangements can be seen in the following:

U.S. Pat. No. 3,736,016 (Garvey et al)
U.S. Pat. No. 3,751,948 (Klein)
U.S. Pat. No. 3,916,654 (Mudge)
U.S. Pat. No. 4,380,160 (Hoffman)
U.S. Pat. No. 4,506,528 (Eberly)
U.S. Pat. No. 4,774,823 (Callison)
U.S. Pat. No. 4,781,043 (Loeffler)
U.S. Pat. No. 4,843,845 (Poe)
U.S. Pat. No. 2,584,575 (Goldwasser)

The common disadvantage reflected in the Prior Art is the limited use or restricted applications of the devices and the expensive construction required.

OBJECTS AND ADVANTAGES

The object of this invention is to provide a simple, versatile protective shield that when used with existing padlocks and installed attachment devices will deter the more common methods of forced attack. Several advantages of this invention are:

(a) The design will accept a variety of U-shackle padlocks in common use.

(b) The design will work in cooperation with many of the fixed and articulated hasp and staple attachment devices in common use.

(c) The design will work in cooperation with many of the closure and latch devices in common use on truck and container doors.

(d) The design will work in cooperation with chain and cable.

(e) The design permits a variety of fabrication methods and materials to assure compatibility with the needs of the application and its economics.

(f) The design provides for the secure association of the shield and padlock when locked but not attached to an attachment device.

DRAWING FIGURES

DESCRIPTION OF A PREFERRED EMBODIMENT

Figure 1:
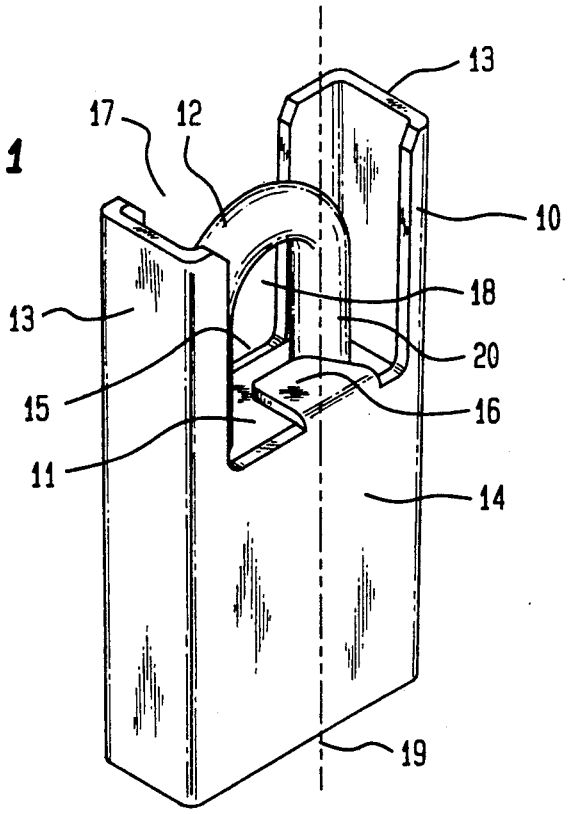
FIG. 1 shows a perspective view of the shield with the padlock in place and the shackle in the locked position.

Refer now to FIG. 1, which is an overall drawing of a preferred embodiment of the invention.

A conventional U-shackle padlock 11 is shown in FIG. 1 with the shackle 12 closed and locked in place within the shield 10. The shield 10 has two identical side walls 13 and different front 14 and rear 15 walls. The front 14 wall includes a tab 16 that projects inwardly to prevent longitudinal travel of the padlock 11 within the shield 10. The tab 16 projects into the internal space established by the side walls 13 a distance such that the tab will interfere with the body of the padlock 11 when moving longitudinally in one direction and with the shackle 12 in the closed and locked position and moving longitudinally in the other direction. The tab 16 is of such a shape and dimension that when the shackle 12 is unlocked, open, and free to rotate about the axis 19 of its retained end 20 there is sufficient clearance for the padlock 11 to be removed or installed within the shield 10.

Figure 2:
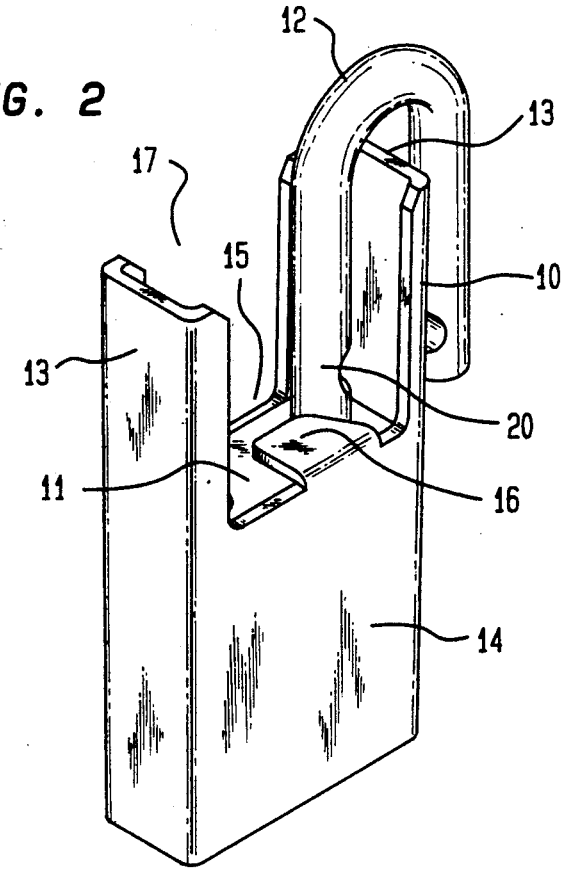
FIG. 2 shows a perspective view of the shield with the padlock in place and the shackle in the unlocked and open position and illustrating the freedom of the shackle to rotate.
Figure 3:
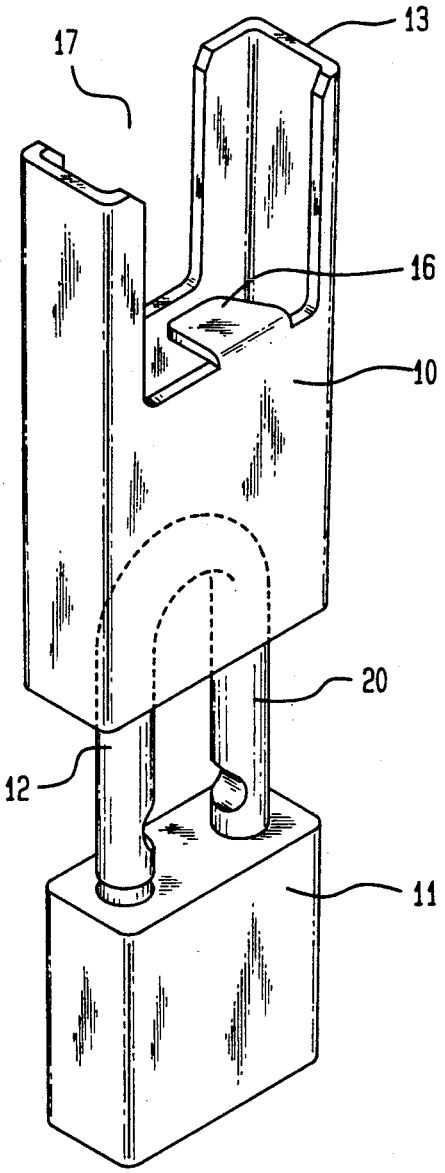
FIG. 3 shows a perspective view of the shield with the padlock in the unlocked and open position and partially removed from the shield.
Figure 4:
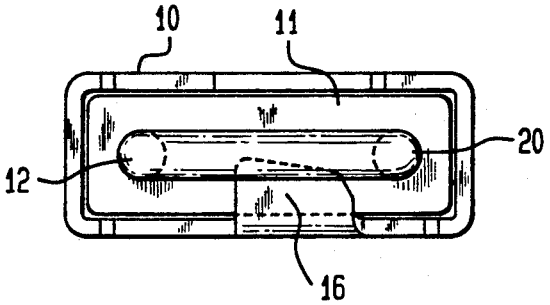
FIG. 4 shows a top view of the shield with the padlock in place and the shackle in the closed and locked position and with the tab preventing removal of the padlock from the shield.
Figure 5:
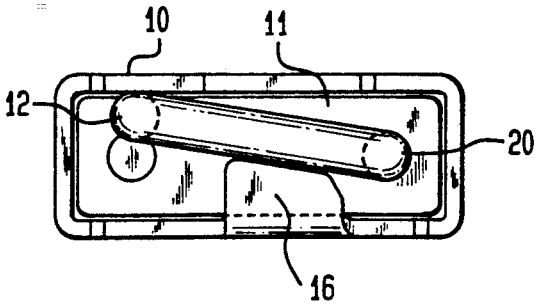
FIG. 5 shows a top view of the shield with the padlock in place and the shackle in the unlocked and open position and rotated sufficiently to clear the tab, permitting the padlock to be removed from the shield.
Figure 8:
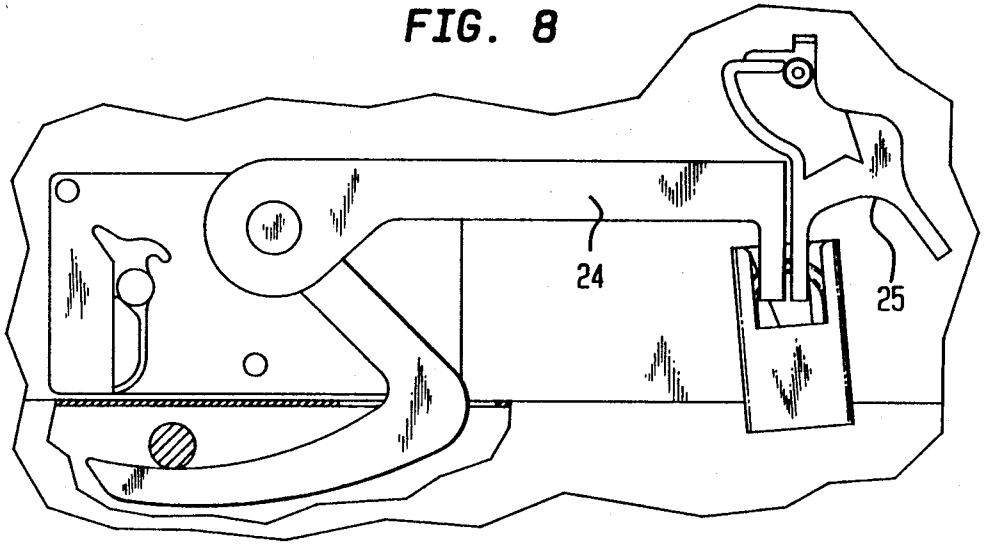
FIG. 8 shows a perspective view of the shield with the padlock in place and the shackle in the locked position attached to the latch handle of a rolldown truck door latch.
Figure 9:
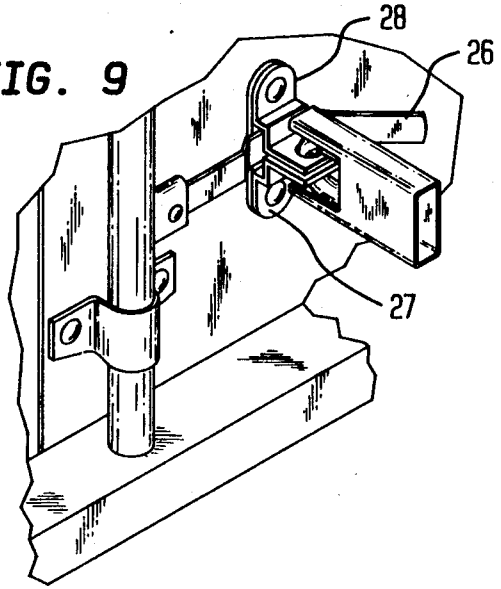
FIG. 9 shows a perspective view of the shield with the padlock in place and the shackle in the locked position attached to the hasp element securing the pivotal lock arm typically used to secure the swing out doors of trucks and cargo containers.
Figure 6:
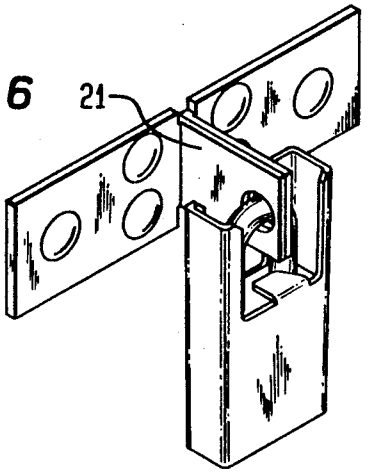
FIG. 6 shows a perspective view of the shield with the padlock in place and the shackle in the locked position attached to a fixed hasp attachment device.
Figure 7:
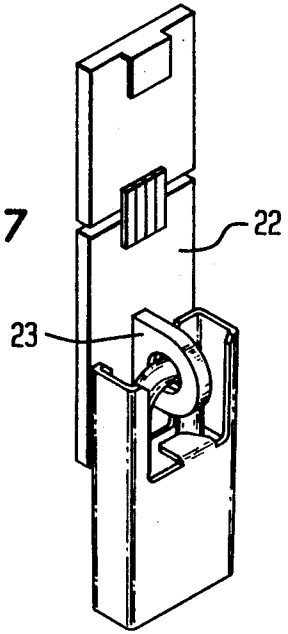
FIG. 7 shows a perspective view of the shield with the padlock in place and the shackle in the locked position attached to the staple on an articulated hasp attachment device.
Figure 10:
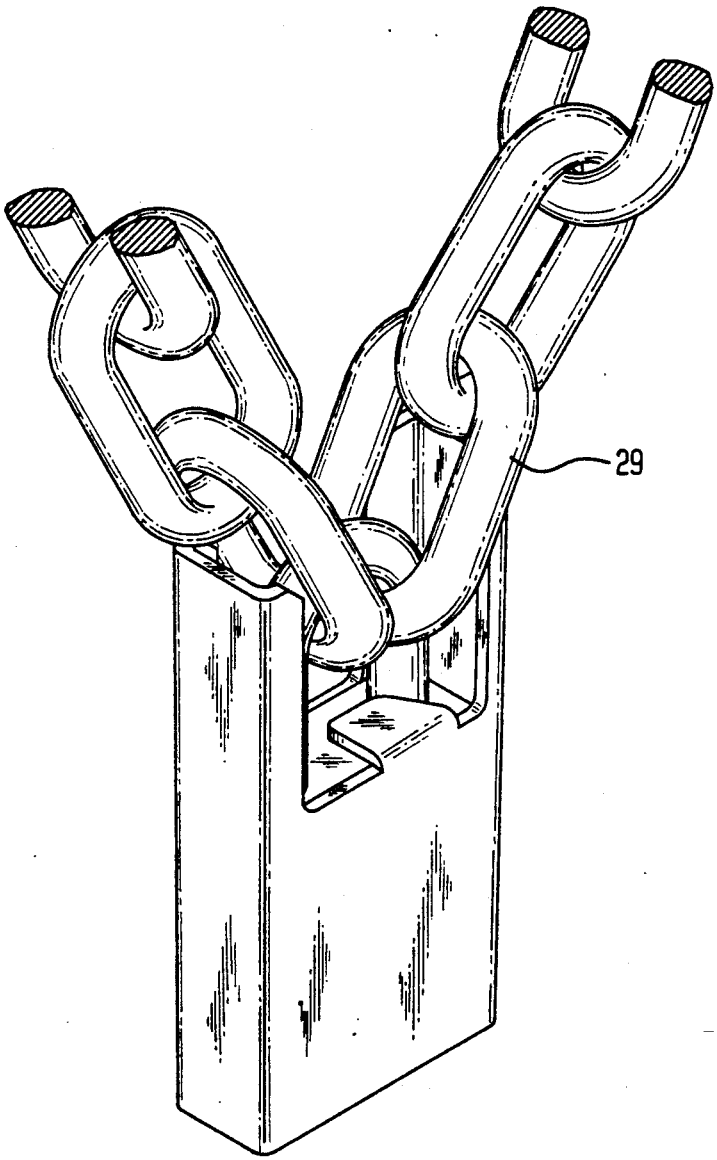
FIG. 10 shows a perspective view of the shield with the padlock in place and the shackle in the locked position attached to two ends of chain.

FIG. 2, illustrates the freedom of the shackle 12 to rotate about the axis of the retained end 20 through the clearance in the front wall 18 and the rear wall 17 to permit ease of connection with the attachment device. FIG. 3 illustrates the padlock 11 and shackle 12 in the unlocked and open position and partially inserted into the shield 10. FIG. 4, illustrates the padlock 11 within the shield 12 in the closed and locked position and tab 16 of such a size and shape as to prevent the removal of the padlock 11 from the shield 12. FIG. 5 illustrates the padlock 11 within the shield 10 with the shackle 12 in the unlocked and open position and rotated about the axis of rotation 19 of the retained end 20 to permit the shackle 12 to clear the tab 16 allowing removal of the padlock 11 from the shield 10. FIG. 6 illustrates a typical fixed hasp 21 attachment device. This device protrudes through the front wall 18 and rear wall 17 clearance described above. FIG. 7, illustrates the same principle applied to an articulated hasp 21 with a staple 22 which engages with the shackle 12. FIG. 8, illustrates a rolldown truck door latch handle 24 in the closed position with the padlock 11 within the shield 10 and the shackle 12 in the closed and locked position engaged with the latch 24 and latch plate 25. FIG. 9, illustrates a pivotal lock arm 26 engaged with the fixed lock arm hasp 27 and movable lock arm hasp 28. The padlock 11 within the shield 10 and the shackle 12 in the closed and locked position are engaged with lock arm hasp elements 27 and 28 to secure pivotal lock arm 26. FIG. 10 illustrates two ends of chain 29 engaged with the shackle 12 which is in the closed and locked position in the padlock 11 which is within the shield 10.

The foregoing describes many of the most commonly used applications for traditional U-shackle padlocks. Without the protective shield described above the shackles and attachment devices are vulnerable to forced attack using well known and readily available tools and methods. This invention provides a tube like shield to accept the conventional padlock of choice, that in combination with the attachment device to be made secure will result in snugly fitting assembly that will deter forced attack.

The foregoing description of the preferred embodiment of the invention has been presented for the purposes of illustration and description. It is not intended to be exhaustive of or to limit the invention to the precise form disclosed, many modifications and variations are possible in light of the above teaching. It is intended that the scope of the invention be limited not by this detailed description, but rather by the claims appended hereto.

I claim:

1. A protective shield for a shackle padlock having a lock body of a predetermined configuration and a U-shaped shackle member having a leg swingably carried by said lock body, said shackle member being movable longitudinally relative to said lock body between a closed, locked position and an open, unlocked position, and said shackle member being freely swingable about said leg when said shackle member is in said open, unlocked position, said protective shield comprising:

a hollow substantially tubular member, having four walls and open at both ends, adapted to receive said shackle padlock within the interior thereof, said hollow tubular member having a hollow interior of the same cross-sectional configuration as said predetermined configuration of said lock body, and the longitudinal dimension of said tubular member being greater than the longitudinal length of said shackle member when said shackle member is in said closed position:

said tubular member having a wall with at least one clearance opening therein which extends from one end of said tubular member toward the other end of said tubular member, said clearance opening being sized and arranged in said wall so that said shackle member may freely swing through said clearance opening when said shackle member is in said open, unlocked position: and a tab projecting from a first wall portion of said tubular member into said interior of said tubular member toward a second opposite wall portion of said tubular member for limiting longitudinal movement of said shackle padlock relative to said tubular member, said tab being dimensioned and arranged so as to be disposed in interfering relationship between said lock body and said shackle member when said shackle member is in said closed, locked position, and yet spaced from said second wall portion a sufficient distance to permit passage of said shackle member between said second wall portion and said tab when said shackle member is in said open, unlocked position and swung toward said second wall portion to thereby permit assembly and disassembly of said shackle padlock in said protective shield.

* * * * *